United States Patent [19]

Carosone

[11] 4,275,745

[45] Jun. 30, 1981

[54] CIGARETTE HOLDER

[76] Inventor: Giorgio Carosone, 738 Arnow Ave., Bronx, New York, N.Y. 10467

[21] Appl. No.: 134,148

[22] Filed: Mar. 25, 1980

[51] Int. Cl.[3] ..... A24F 13/04

[52] U.S. Cl. ..... 131/270; 131/187

[58] Field of Search ..... 131/8 A, 171 A, 170 R, 131/170 A, 187, 256

[56] References Cited

U.S. PATENT DOCUMENTS

| | | | |
|---|---|---|---|
| 3,006,346 | 10/1961 | Golding | 131/187 X |
| 3,812,865 | 5/1974 | Anderson | 131/171 A |

*Primary Examiner*—Stephen C. Pellegrino

*Attorney, Agent, or Firm*—Homer J. Bridger

[57] ABSTRACT

A cigarette holder for assisting a smoker in stopping smoking has an outer tube whose rear end is provided with a mouthpiece and whose front end is provided with a metal snuffing collar. Inside this other tube is another tube that acts as a stop for a cigarette inserted into the outer tube, and that is provided with break formations such as grooves or notches so that it can be shortened. This inner tube is therefore periodically shortened so that the amount of cigarette that can be inserted or received within the holder and in back of the snuffing collar increases. Thus the amount of each cigarette that can be smoked with the holder can be decreased step-wise to allow the user to reduce the amount of each cigarette smoked. Ultimately cigarette smoking can thus be stopped.

11 Claims, 2 Drawing Figures

CIGARETTE HOLDER

FIELD OF THE INVENTION

The present invention relates to a cigarette holder. More particularly this invention is directed to such devices structured to aid a smoker in giving up smoking.

BACKGROUND OF THE INVENTION

As the deleterious health effects of cigarette smoking have become universally recognized and accepted, a need has developed for a means to enable a smoker to wean himself or herself from cigarettes. Simply stopping smoking requires more will power than is often available, and other means by which smokers gradually decrease their consumption of cigarettes have generally not met with significant success.

A cigarette holder is known which is provided with a set of filters of graduated porosity and set up so that the less porous filters admit more outside air through lateral vents in the holder. A would-be nonsmoker periodically changes the filter, switching it for one that passes less smoke and admits more air until theoretically he or she is smoking nothing but air. Although this arrangement does give the oral gratification of smoking, the taste is often so inferior that the procedure rarely is successfully followed to completion.

OBJECTS OF THE INVENTION

It is therefore an object of the instant invention to provide an improved cigarette holder.

Another object is to provide such a holder which can be used to wean a person of cigarettes or other smokables.

SUMMARY OF THE INVENTION

These objects are attained according to the instant invention in a cigarette holder having an outer tube whose cylindrical inner wall has a diameter that is equal to that of a cigarette and that is provided at its rear end with a mouthpiece and at its front end with an extinguishing collar of the type described in U.S. Pat. Nos. 1,792,430, 1,863,000 and 2,240,538. According to the invention the tube is provided inside itself with a shortenable element having a plurality of formations that allow it to be reduced in length. A cigarette can only be inserted into the outer tube until it engages backwardly against the front face of the inner element, and the cigarette can only burn back to the extinguishing collar at the front end. Thus as the inner element is shortened the length of the cigarette that can be smoked is automatically reduced.

The would-be nonsmoker therefore merely periodically shortens the inner element, thereby regularly reducing the amount of each cigarette he or she smokes. The formations—normally notches or fractures grooves—are closely enough spaced that the reduction in smoking is not noticeable, but with time the smoker can readily become adjusted to a very short smoke, and can eventually give it up altogether. Meanwhile the continuously reduced smoking is as tasteful and satisfying as hitherto, but just less of each cigarette is consumed.

In accordance with further features of this invention the inner element is a tube concentrically received within the outer tube and having an outer diameter equal substantially to the inner diameter of the outer tube. This inner tube therefore forms a continuation of the smoke passage extending backwardly from its front face through the mouthpiece, so that the user draws smoke in through the inner tube and mouthpiece.

The inner and outer tubes are made according to this invention of a heat-resistant synthetic resin, the outer tube being constructed of a transparent resin if desired. The extinguishing collar is preferably metal or any high heat content and heat conductive material so that when the cigarette, by which is meant in this context any cylindrical smokable, burns down to this ring the cigarette is snuffed out.

BRIEF DESCRIPTION OF THE DRAWING

The FIG. 1 of the drawing is a longitudinal section through the holder according to this invention.

Figure 1:
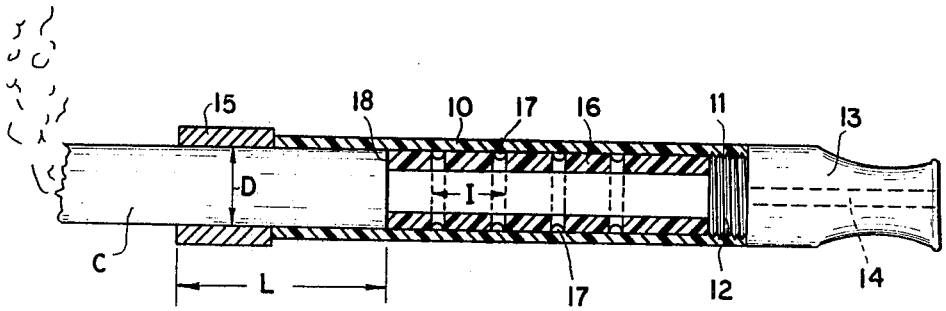
As seen in FIG. 1 a holder for a cigarette C has an outer synthetic-resin tube 10 having a front end to the left in the drawing and a rear end provided with screw-threads 11 that mete with complementary screw-threads 12 of a standard mouthpiece 13 having a central smoke passage 14. Force-fitted to the front end of this tube 10 is the metal collar 15 having the same inner diameter D as the tube 10, which diameter D is substantially equal to the outer diameter of the cigarette C.

According to this invention an inner abutment tube 16 is carried concentrically inside the outer tube 10 with its outer wall snugly engaging the inner wall of the outer tube 10. This inner tube 16 may be integrally formed with the mouthpiece 13 and forms an extension of the passage 14. Along its length the tube 16 is formed with radially outwardly open notches or grooves 17. This tube 16 is of a frangible synthetic resin so that it can easily be broken off at any of the weakened regions formed by the grooves 17 that reduce the cross-sectional area of the tube 16.

It is therefore possible for the user of the holder according to this invention to break off the tube 16. As this tube 16 has a front face 18 which is spaced by a distance having a length L from the mouth of the holder as defined by the front edge of the extingushing collar 15, this shortening action will create a new front face 18 which will be spaced further inwardly by an increment I.

To start the reduction to abstention regime the user will smoke using the holder for at least a week, for example, so that the cigarette C will only by extinguished when the butt or section remaining in the holder has the length L, which to start with corresponds to a standard butt length. After this time the first end section of the tube 16 is broken off at the first groove 17 so that when a cigarette is inserted fully into the holder it will be extinguished by the collar 15 when it has a length equal to L+I. In this manner the smoker will smoke less of each cigarette during the second similar period. Obviously the procedure is continued so that after a second shortening at the start of the third period a butt having a length equal to L+2I will remain, and so on. Eventually the user will only be able to smoke a small portion of a cigarette with the inventive cigarette holder, so that giving up smoking altogether will be relatively painless.

The holder according to the instant invention therefore allows a smoker to cut down his smoking without actually cutting down the number of cigarettes smoked daily. Instead less of each cigarette is smoked. Such tapering-off is the only method by which many smokers can give up their habits.

Figure 2:
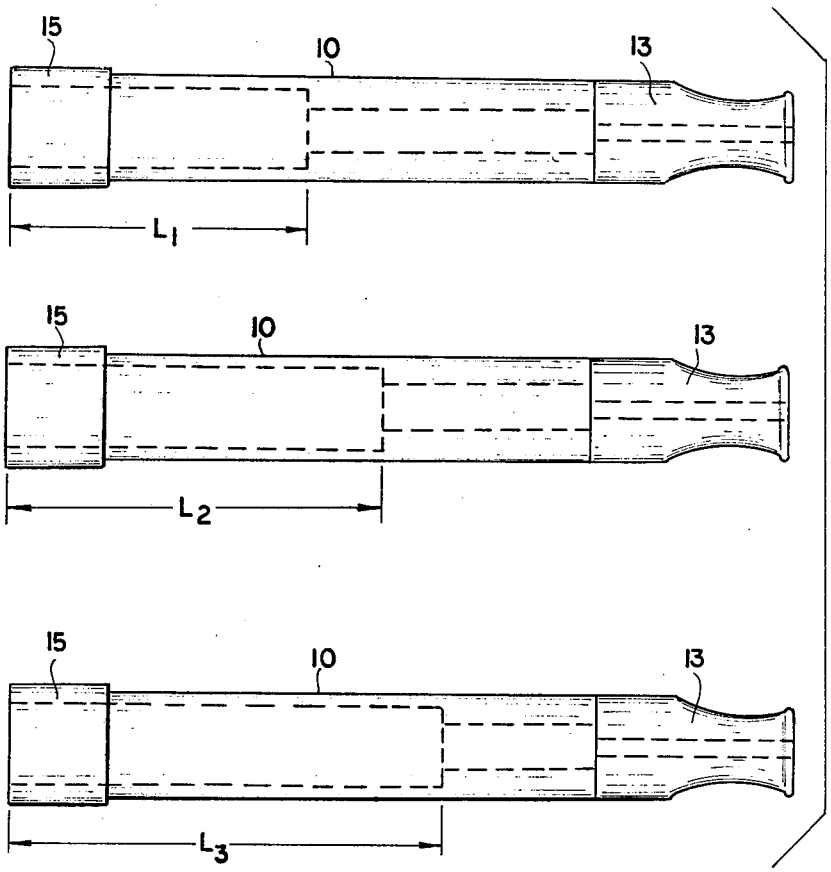
FIG. 2 shows longitudinal sections through the set of holders according to another aspect of the invention or at various withdrawal stages of the holder of FIG. 1.

FIG. 2 shows how, instead of breaking off the inner tube 16 of the holder periodically, it is possible merely to switch from one holder to the next one of a set. Thus the first holder of the set would have the abutment formed by the front end of the tube at the distance L as seen in FIG. 1, the second at somewhat greater distance $L_1$ as seen in FIG. 2, the third at somewhat greater distance $L_2$, and the fourth at yet greater distance $L_3$. Thus the user would buy a set of at least three such graduated holders, and would switch to the next deepest holder periodically. Such an arrangement could advantageously be combined with an internal filter which would automatically clog up and effectively prevent further use of the specific holder after a certain number of cigarettes had been smoked or a certain amount of cigarette residue had accumulated therein.

The holders of FIGS. 1 and 2 may be fitted with devices for ejecting the unconsumed portions of cigarettes from the holder. These may be actuated from either end of the holder of this invention.

I claim:

1. A cigarette holder comprising:

an outer tube having a cylindrical inner wall of a diameter equal generally to that of a cigarette, a front end, and a rear end;

a mouthpiece at said rear end, whereby a cigarette can be inserted into said front end and smoke therefrom drawn through said mouth-piece;

an inner element in said interior extending forwardly from said rear end and having a front face forming a backward stop for a cigarette inserted into said front end, whereby a cigarette can only be inserted backwardly into said front end until engagement with said front face;

means including a succession of longitudinally spaced formations along said element for longitudinally shortening said element by breaking at said formations and thereby moving said front face backwardly, whereby when said element is shortened, more of a cigarette can be inserted into said outer tube and;

means at said front end for extinguishing a cigarette which is received in said outer tube and has burned down to said front end.

2. The holder defined in claim 1 wherein said element is an inner tube concentrically received in said outer tube.

3. The holder defined in claim 2 wherein said means at said front end is a metallic collar having an inner diameter equal substantially to the outer diameter of a cigarette.

4. The holder defined in claim 2 wherein said formations are reductions in cross-sectional area of said inner tube.

5. The holder defined in claim 4 wherein said formations are notches.

6. The holder defined in claim 2 wherein said mouthpiece and rear end are provided with complimentary screw-threads connecting each other together.

7. The holder defined in claim 2 wherein said outer tube is of a synthetic resin.

8. The holder defined in claim 2 wherein said inner tube is of a synthetic resin.

9. The holder defined in claim 2 wherein the inner and outer diameters respectively of said outer tube and inner tubes are substantially the same.

10. The holder defined in claim 2 wherein said formations are longitudinally equi-spaced along said inner tube.

11. A set of a least three cigarette holders according to claim 1 each comprising:

an elongated tube having a forwardly open cigarette-receiving front end, a rear end, and internal structure forming an abutment spaced a distance from said front end for a cigarette inserted into said front end;

a mouthpiece at said rear end; and a cigarette-snuffing ring at said front end and of an internal diameter substantially equal to the outside diameter of a standard cigarette and of a fire proof material, the distances from said front ends to the respective abutments being graduated from holder to holder of said set, whereby each holder extinguishes a cigarette fully inserted into itself when the butt length is different from that of the other holders of said set.

* * * * *